United States Patent [19]

Keppel et al.

[11] Patent Number: 4,521,910

[45] Date of Patent: Jun. 4, 1985

[54] MULTIWALL COOLER BAG

[75] Inventors: Stephen C. Keppel, Ridgefield, Conn.; Donald O. Newton, Washingtonville, N.Y.; Stephen R. Salt, Danbury, Conn.

[73] Assignee: St. Regis Corporation, New York, N.Y.

[21] Appl. No.: 602,134

[22] Filed: Apr. 19, 1984

[51] Int. Cl.[3] ..... B65D 30/08; B65D 33/08

[52] U.S. Cl. ..... 383/10; 383/61; 383/88; 383/110; 383/113

[58] Field of Search ..... 383/113, 110, 61, 88, 383/10

[56] References Cited

U.S. PATENT DOCUMENTS

| | | | |
|---|---|---|---|
| 232,930 | 10/1880 | Bower | 383/113 |
| 1,944,613 | 1/1934 | Rowe | 383/113 |
| 2,435,743 | 2/1948 | Geimer | 383/88 |
| 2,737,339 | 3/1956 | Doyle | 383/61 |
| 3,325,082 | 6/1967 | Naylor | 383/113 |
| 3,454,441 | 7/1969 | Spruyt | 383/10 |
| 3,468,470 | 9/1969 | Sengewald | 383/10 |
| 3,927,825 | 12/1975 | Stearly | 383/113 |
| 3,958,749 | 5/1976 | Goodrich | 383/113 |

FOREIGN PATENT DOCUMENTS

| | | | |
|---|---|---|---|
| 2641484 | 3/1978 | Fed. Rep. of Germany | 383/110 |
| 1365038 | 5/1963 | France | 383/10 |

*Primary Examiner*—Stephen P. Garbe

*Attorney, Agent, or Firm*—Joseph M. Maguire

[57] ABSTRACT

A multiwall cooler bag is formed by gusseted inner and outer tubes, the outer tube being made of kraft paper and having its lower end circumferentially bonded to the inner tube, the inner tube comprising an inner ply of plastic material heat sealed to closure at its lower end and an outer ply of kraft paper, with a strip of plastic reinforcing material extending the length of and secured to the back and front walls of the outer tube. The front wall of the outer tube has its lower end formed with a closure flap secured to the back wall of the outer tube, while the back wall of the outer tube has its upper end formed with a closure flap overlapping the front wall when the bag is completely closed. The upper portion of the inner tube is free of the outer tube to permit independent closing of the inner tube before closing the outer tube. An aperture is formed in the strip-reinforcing portion and at the upper end of the back and front walls of the outer tube and has a tongue at its upper edge, with the tongues being proportioned and arranged for bending through the apertures and upwardly against the upper closure flap to cooperate with the upper closure flap to provide a reinforced grip.

5 Claims, 8 Drawing Figures

MULTIWALL COOLER BAG

BACKGROUND OF THE INVENTION

This invention relates in general to bags and, more particularly, to a multiwall bag constructed and arranged to contain food and/or beverages packed in ice or other suitable cooling medium to cool them or keep them cool.

Consumers buy over $40 million in light-weight coolers, and they would buy more if they could find a cooler that satisfied their needs. Most of such coolers are in the form of expanded rigid polystyrene plastic containers which are cumbersome to carry and to store. Consumers are looking for a cooler that is easy to carry, easy to store and disposable for no carry-back.

Multiwall cooler bags are known wherein the bag is composed of a single gusseted tube sewn at the bottom and formed by several outer plies of kraft paper and an inner ply of plastic material, with paper handles secured by paper strips to the outer surface of the upper end of the front and back walls of the bag. After the bag is filled, its upper end is folded over by hand several times to a position below the upper edges of the handles to permit carrying of the bag. One problem which has plagued a bag of this type is the fragility of the handles and their strip fasteners, often resulting in failure under load of the handles and/or of the fasteners. Another problem with a bag so constructed is that it has a tendency to leak.

SUMMARY OF THE INVENTION

The general object of the present invention is the provision of a multiwall cooler bag having the virtues of simplicity, reliability and strength, of being easy to carry, easy to store, disposable and leakproof, and having the capability of holding two six packs of soda or beer plus ice and of keeping its contents cold for hours.

In accordance with the invention, a multiwall cooler bag is formed by inner and outer tubes having back and front walls connected by gussets, the outer tube being constructed of kraft paper and having its lower end circumferentially bonded to the inner tube, the inner tube comprising an inner ply of plastic material heat sealed to closure at its lower end and an outer ply of kraft paper. A strip of plastic reinforcing material extends the length of and is secured to the back and front walls of the outer tube. The front wall of the outer tube has its lower end formed with a closure flap overlapping and secured to the back wall of the outer tube, while the back wall of the outer tube has its upper end formed with a closure flap overlapping the front wall when the bag is completely closed. The upper portion of the inner tube is free of the outer tube to permit independent closing of the inner tube before closing of the outer tube. An aperture is formed in the strip-reinforcing portion and at the upper end of the back and front walls of the outer tube and has a tongue at its upper edge, the tongues being proportioned and arranged for bending through the apertures and upwardly against the upper closure flap to cooperate with the upper closure flap to provide a reinforced grip which is an integral part of the bag.

DESCRIPTION OF THE PREFERRED EMBODIMENT

Figure 1:
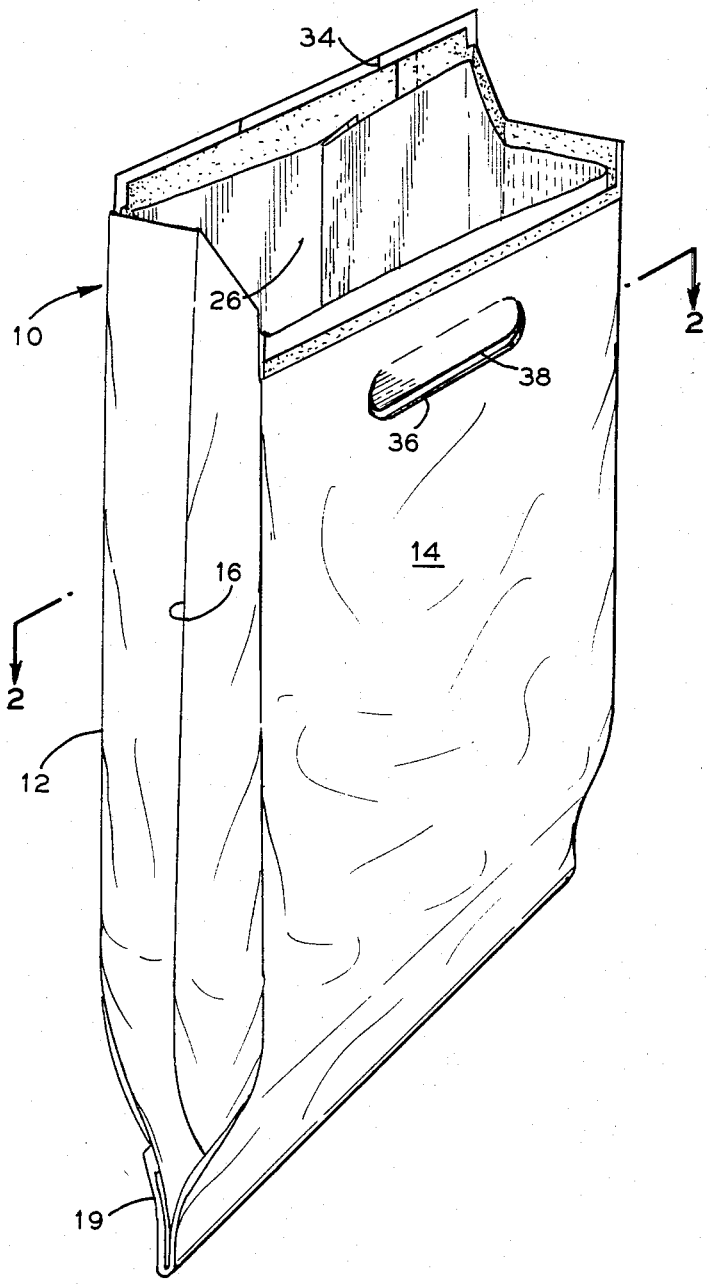
FIG. 1 is a perspective view of a bag constructed in accordance with the invention.
Figure 2:
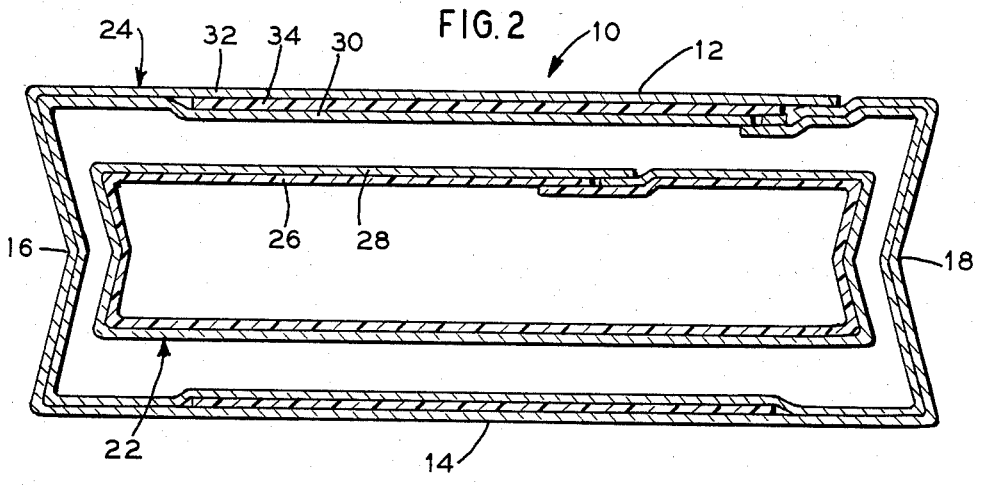
FIG. 2 is a cross-sectional view taken along the line 2—2 of FIG. 1.

Referring now to the drawings in detail, wherein like numerals indicate like elements throughout the several views, the cooler bag 10 of the invention is primarily intended to contain food and/or beverages covered by ice or other suitable cooling medium to cool them or keep them cool. The bag as manufactured comprises oppositely disposed back and front walls 12 and 14 connected by gussets 16 and 18, and is open at the top and closed at the bottom by a seal flap 19 hingedly coupled to the lower end of front wall 14 along fold line 20.

Bag 10 includes an inner tube 22 and an outer tube 24, each tube being formed in a conventional manner of multiple plies of material. Inner tube 22 has an inner ply 26 of heat sealable thermoplastic material and an outer ply 28 of nonheat sealable material having its opposite ends circumferentially bonded to inner tube 22. Outer heat 24 is composed of two plies 30 and 32 of nonheat sealable material circumferentially bonded to each other at their opposite ends. Front wall 14 of tube 24 has its lower end formed with flap 19 which overlaps and is sealed to back wall 12 by a layer of conventional hot melt adhesive formed ont the inner surface of flap 19; while back wall 12 of the tube 24 has its upper end formed with a closure flap 33 which overlaps front wall 14 when the bag is completely closed.

Inner ply 26 of tube 22 may be made of any thermoplastic material capable of containing liquids, such as low or high density polyethylene. Plies 28, 30 and 32 may be made of kraft paper, although other suitable flexible sheet stock may be used.

A strip of thermoplastic reinforcing material 34, such as high density polyethylene, extends the length of and is secured to the back and front walls 12 and 14 of outer tube 24. An oval shaped aperture 36 is formed in the strip reinforcing portion and at the upper end of the back and front walls 12 and 14 and has a tongue 38 at its upper edge. Tongues 38 are proportioned and arranged for bending through apertures 36 and upwardly against flap 33 when closed and cooperate with flap 33 to provide a reinforced grip.

Figure 3:
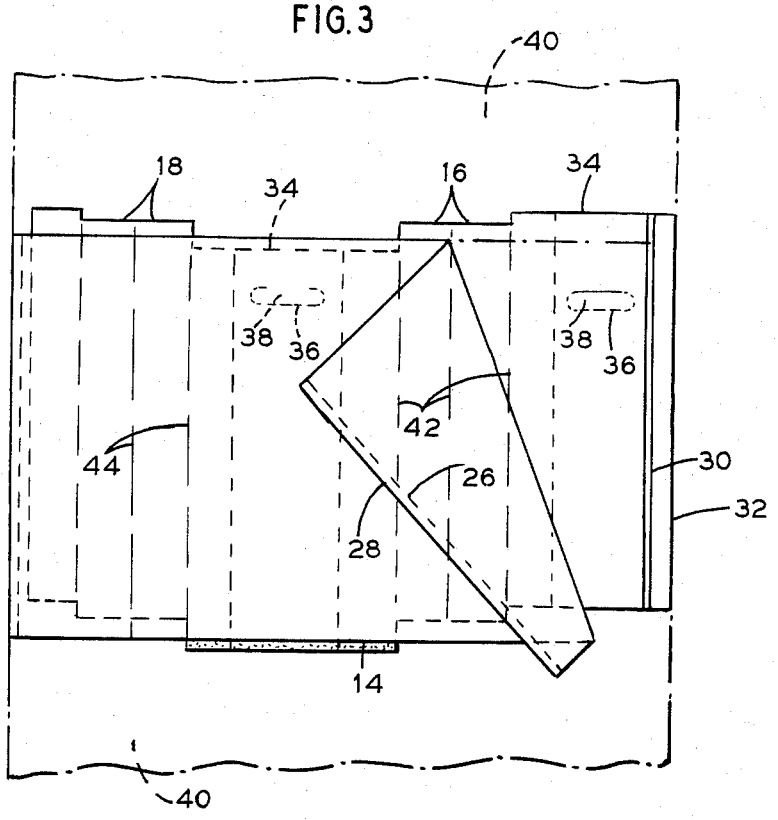
FIG. 3 is a plan view of the bag blank.
Figure 4:
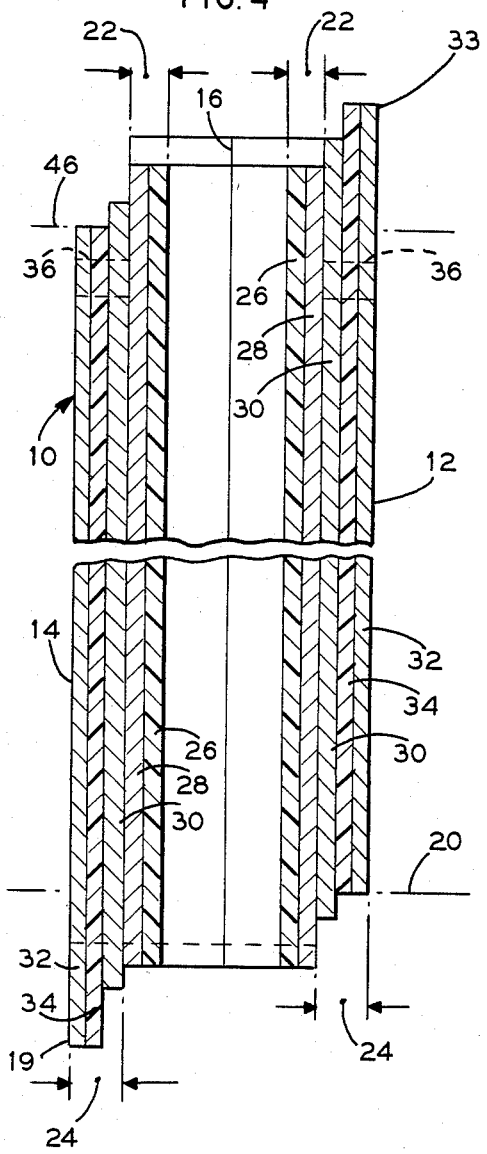
FIG. 4 is a vertical section of an open-ended bag blank as produced on a conventional stepped end tuber for conversion to a bag according to FIG. 1.
Figure 5:
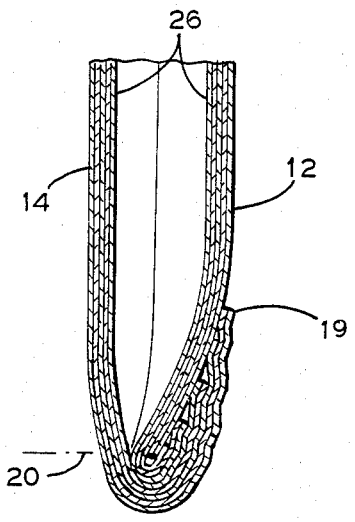
FIG. 5 is a fragmentary sectional view similar to FIG. 4 showing the lower end of the bag in its closed position.
Figure 6:
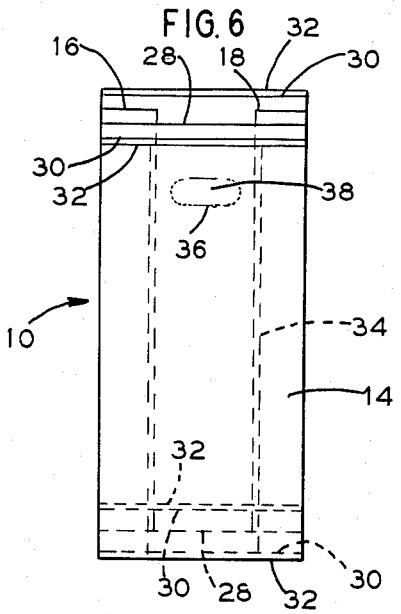
FIGS. 6 and 7, respectively are the front and back plan views of a bag formed from the blank of FIG. 3, these views showing the front and back surfaces collapsed against the interposed and collapsed gussets.
Figure 7:
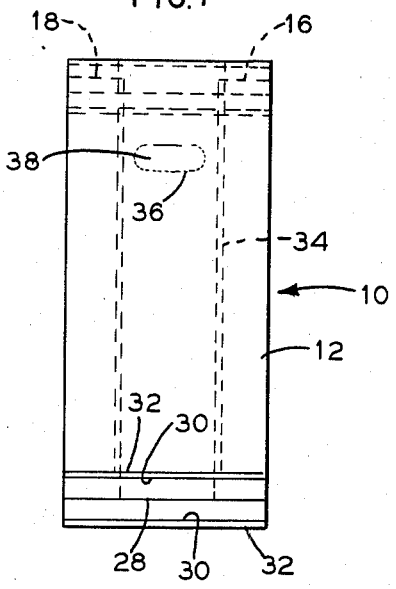

With reference to FIG. 3, bags of the invention may be quantity produced from superimposed webs of the plastic and paper plies. The individual webs are transversely perforated at bag length intervals to impart the requisite end configurations to the bag blanks. These perforations are provided for subsequent separation of the web stock into successive bag blanks, portions of adjacent bag blanks being indicated by the phantom lines 40. The perforations at one end of a bag blank are complimentary to those at the opposite end to prevent waste of material.

Each ply of the bag blank includes back and front walls 12 and 14 connected by gussets 16 and 18, with the longitudinal edges of back wall 12 of each ply being joined in overlapping relation when the bag is assembled. The upper and lower edges of the gussets and back wall 12 on each side of front wall 14 of outer tube 24 are stepped successively upward with respect to the corresponding edges of front wall 14. The upper and lower edges of the gussets and front and back walls of inner tube 22 are flush cut and positioned, when the bag blank is formed, intermediate the corresponding edges of the gussets and front wall 14 of outer tube 24. The plies of each blank are also successively stepped transversely of their lengths to provide longitudinally extending overlapping edges, with each ply being bonded to itself along its longitudinal edges when the bag is assembled.

Strips 34 of reinforcing material are stripe-glue laminated to the inner surface and extend the full length of back and front walls 12 and 14 of ply 32, each strip covering a major portion of the corresponding wall. While such strips are shown as sandwiched between plies 30 and 32, alternatively they may be bonded to the inner surface of ply 30 of back and front walls 12 and 14.

In forming each aperture 36, corresponding plies 30 and 32 and strip 34 are perforated to provide tongue 38 extending from the upper edge of the aperture. These apertures are positioned in corresponding back and front walls 12 and 14 so that they are in alignment with each other when plies 30 and 32 are formed into a tube.

With the plies constructed and arranged as above described, the inner and outer tubes are formed by folding over the plies so that their oppositely stepped longitudinal edges overlap each other, by adhesively bonding the overlapping longitudinal edges of ply 26, and by gluing each of plies 28, 30 and 32 to itself along its overlapping longitudinal edges. During the tube forming operation, each blank is reversely creased along lines 42 and 44 to form oppositely disposed gussets 16 and 18. Then the bottom or lower end of ply 26 is heat sealed to closure. As shown in FIGS. 4–7, at this point the oppositely disposed apertures 36 are in alignment with each other, the upper ends of gussets 16 an 18 overlap front wall 14, the upper end of back wall 12 overlaps the upper ends of the gussets, the lower end of tube 22 overlaps back wall 12, and the lower end of front wall 14 overlaps the lower end of tube 22 and the lower end of front wall 14. Thermoplastic adhesive is applied to the inner surface of flap 19 which is folded over along line 20 and secured by compression to back wall 12 to complete the bottom closure of the bag. It should be noted that in producing this closure the heat sealed portion of the lower end of tube 22 that overlaps front wall 14 is also secured to front wall 14 along with flap 19. The upper or remaining portion of inner tube 22 is free of outer tube 24 to permit independent closing of the inner tube before closing the outer tube.

Figure 8:
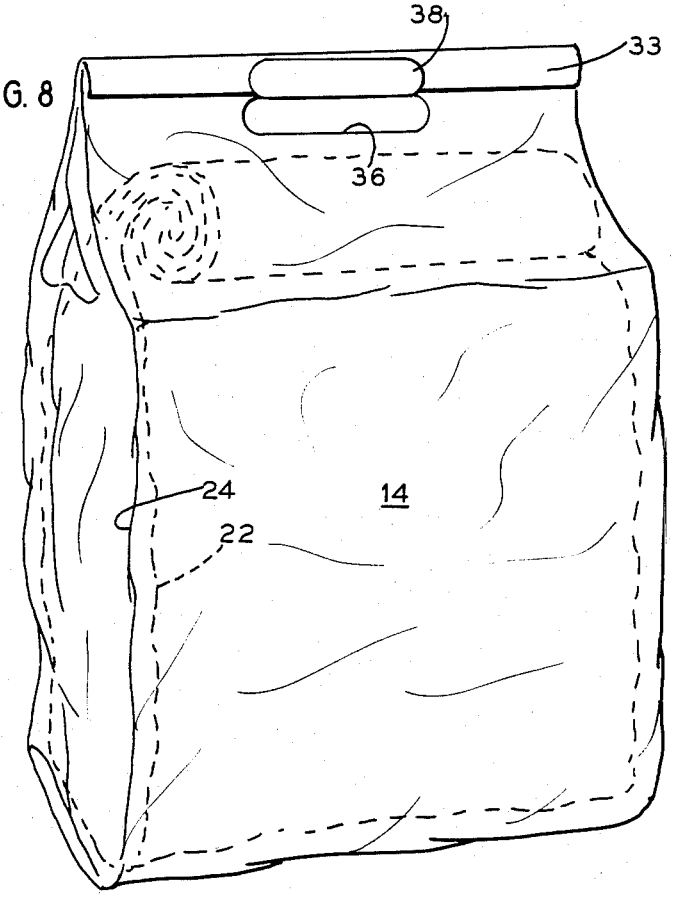
FIG. 8 is a perspective view of the bag in its filled and closed condition.

Referring to FIG. 8, after filling inner tube 22 with material to be cooled or kept cool, such as six-packs of beer or soda, and covering the material with ice or other suitable cooling medium, the upper end of inner tube 22 is folded over by hand several times to a position below apertures 36 to close the inner tube and to force out most of the air inside, thereby enhancing the cooling effect of the cooling medium. Then flap 33 and the upper ends of gussets 16 and 18 are folded over by hand along fold line 46 against front wall 14 so that the leading edge of flap 33 is coincident with the upper edges of apertures 36, followed by bending of tongues 38 through apertures 36 and upwardly against the outer surface of flap 33 to provide a reinforced handle formed integrally with the bag walls and consisting of fourteen layers of material.

We claim:

1. A multiwall cooler bag comprising inner and outer tubes having front and back walls connected by gussets, the inner tube comprising a ply of heat sealable material having its lower end heat sealed to closure, a strip of reinforcing material extending the length of and secured to the back and front walls of the outer tube, the front wall of the outer tube having its lower end formed with a closure flap overlapping and secured to the back wall of the outer tube, the back wall of the outer tube having its upper end formed with a closure flap overlapping the front wall of the outer tube when the bag is completely closed, the upper portion of the inner tube being free of the outer tube to permit independent closing of the inner tube before closing of the outer tube, an aperture formed in the strip-reinforcing portion and at the upper end of the front and back walls of the outer tube and having a tongue at its upper edge, the tongues being proportioned and arranged for bending through the apertures and upwardly against the upper closure flap to cooperate with the upper closure flap to provide a reinforced grip which is an integral part of the bag.

2. A multiwall cooler bag as recited in claim 1, in which the inner and outer tubes are composed of several plies, the inner ply of the inner tube is made of a thermoplastic material, the remaining plies of the inner and outer tubes are made of kraft paper, and the reinforcing strips are made of high density polyethylene.

3. A multiwall cooler bag as recited in claim 1, in which the gussets cooperate with the upper end of the front wall of the outer tube to form the upper closure flap.

4. A multiwall cooler bag as recited in claim 1, in which the inner tube has its lower end circumferentially bonded to the outer tube, and the lower end of the inner tube overlaps and is secured to the front wall along with the lower closure flap.

5. A multiwall cooler bag as recited in claim 4, in which the length of the upper closure flap is such that its leading edge is coincident with the upper edges of the apertures when the upper closure flap is folded over against the front wall.

* * * * *